United States Patent [19]

Ellison et al.

[11] 4,051,861

[45] Oct. 4, 1977

[54] ARRANGEMENT FOR CONNECTING MANIFOLD BLOCKS

[75] Inventors: John E. Ellison, Newington; Herbert M. Flink, East Hartford, both of Conn.

[73] Assignee: Skinner Precision Industries, Inc., New Britain, Conn.

[21] Appl. No.: 628,379

[22] Filed: Nov. 3, 1975

[51] Int. Cl.[2] ..... F15B 13/08

[52] U.S. Cl. ..... 137/315; 285/137 R

[58] Field of Search ..... 137/315, 561 R; 285/137 R

[56] References Cited

U.S. PATENT DOCUMENTS

| | | | |
|---|---|---|---|
| 3,654,947 | 4/1972 | Hatch et al. | 137/833 |
| 3,654,960 | 4/1972 | Kiernan | 137/608 |
| 3,756,274 | 9/1973 | Wolfgramm | 137/561 R |

*Primary Examiner*—Alan Cohan
*Assistant Examiner*—Gerald A. Michalsky
*Attorney, Agent, or Firm*—Prutzman, Hayes, Kalb & Chilton

[57] ABSTRACT

An arrangement which connects a pair of valve mounting manifold blocks in end-to-end abutment includes each block having an opening in oneend thereof, the respective end openings in the pair of blocks being in registry with one another when the respective ends of the pair of blocks are aligned and abut one another. A fastener extends from the opening in one block into the opening in the other block, and the opposite ends of the fastener are respectively fixed to the blocks such that the fastener is contained substantially entirely within the blocks. The openings may be defined by slots in the bottom of each block and the fastener may be a screw extending within the slots in threaded engagement with a nut.

7 Claims, 4 Drawing Figures

FIG. 1
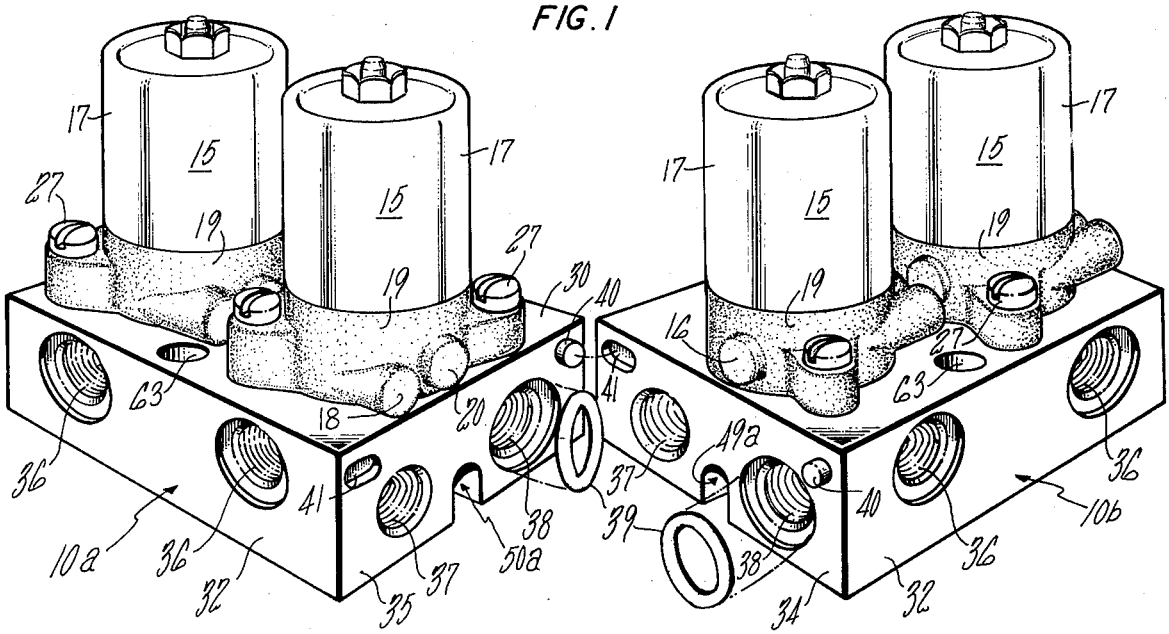
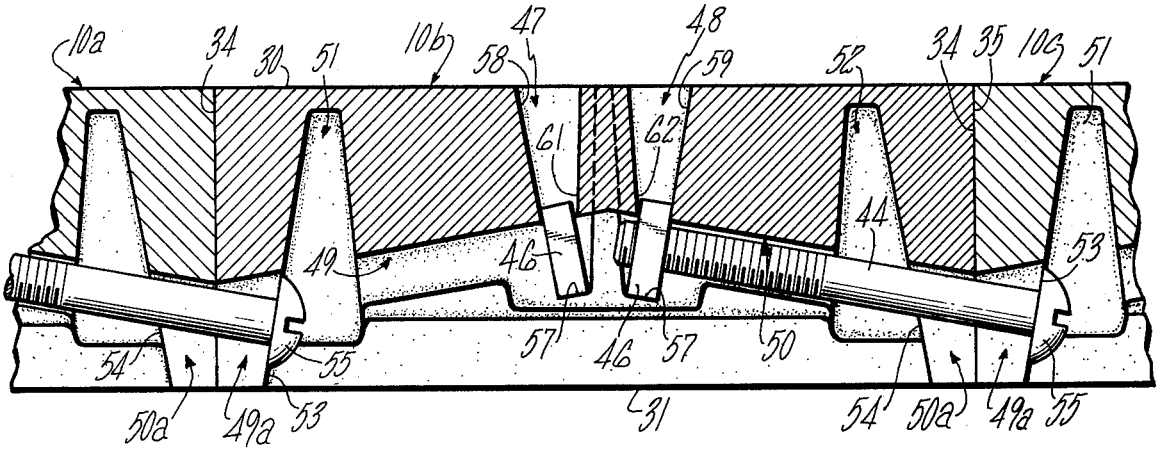
FIG. 3

FIG. 2
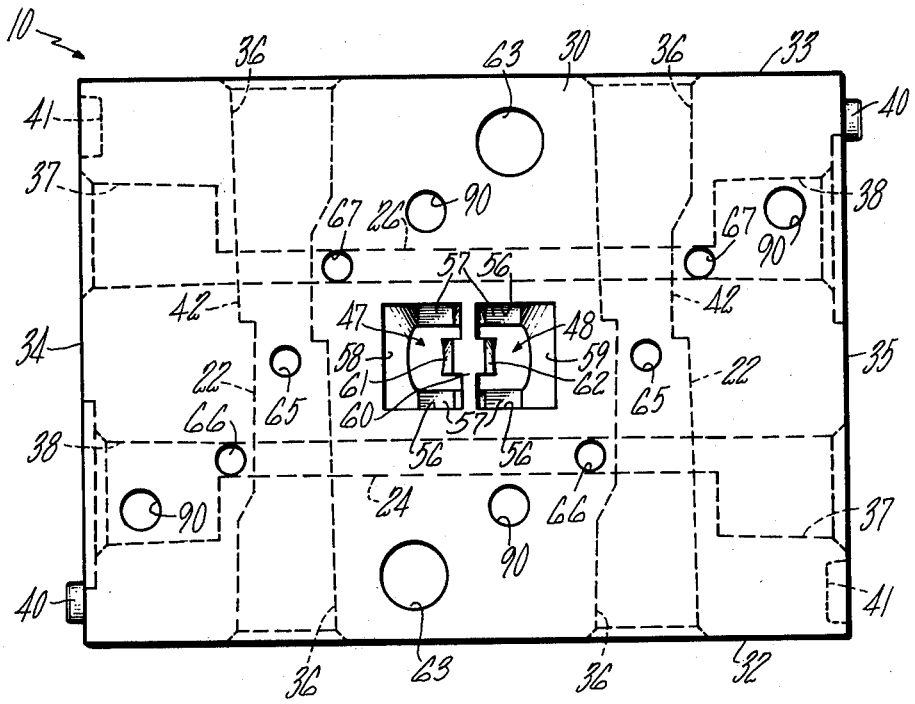
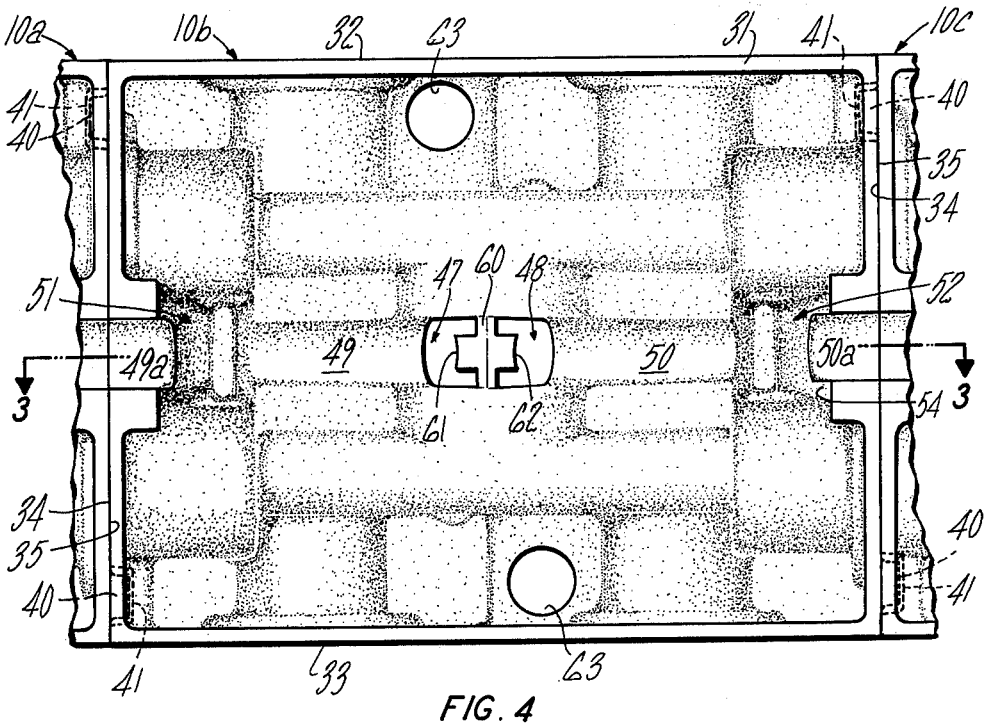
FIG. 4

ARRANGEMENT FOR CONNECTING MANIFOLD BLOCKS

BRIEF SUMMARY OF THE INVENTION

The invention relates generally to a connecting arrangement and more specifically to an arrangement for connecting a plurality of fluid control valve manifold blocks in stacked end-to-end engagement.

The primary object of this invention is to provide an improved arrangement for connecting fluid control valve manifold blocks in stacked engagement which permits the use of an inexpensive standard readily available fastener.

Another object of this invention is to provide an improved arrangement for connecting fluid control valve manifold blocks in stacked engagement which is compact and minimizes projections from the connected blocks.

Still another object of this invention is to provide an improved arrangement for connecting fluid control valve manifold blocks in stacked end-to-end engagement which permits reversing the blocks end-to-end for the connection.

A still further object of this invention is to provide an improved arrangement for connecting fluid control valve manifold blocks in stacked engagement which eliminates the need for machining openings and/or seats for the connecting fastening means.

An even further object of this invention is to provide an arrangement for connecting fluid control valve manifold blocks in stacked engagement utilizing a single fastener for interconnecting each pair of adjacent stacked blocks. Further included in this object is the provision of a manifold block connecting arrangement which uses a nut and bolt as the fastener. Included in this object is the provision of such a manifold block structure which will retain the nut operatively positioned prior to assembly.

Other objects will be in part obvious and in part pointed out more in detail hereinafter.

A better understanding of the invention will be obtained from the following detailed description and the accompanying drawings of an illustrative application of the invention.

BRIEF DESCRIPTION OF THE DRAWINGS

In the drawings:

FIG. 1 is an exploded view of a pair of manifold blocks each mounting two valves and shown rotated out of stacked alignment and engagement;

FIG. 2 is a top view of one of the manifold blocks depicted in FIG. 1 with the valves removed;

FIG. 3 is a sectional side view, as taken substantially along line 3—3 of FIG. 4, showing three manifold blocks in stacked relationship and including the connecting fasteners; and FIG. 4 is a bottom view of three manifold blocks in end-to-end stacked engagement with the connecting fasteners removed.

DESCRIPTION OF THE PREFERRED EMBODIMENT

Referring now to the drawings in greater detail wherein like reference numerals represent like parts throughout the several figures, and initially to FIG. 1, a pair of modular manifold blocks 10a and 10b each support a pair of identical fluid control valve assemblies 15.

Each control valve assembly 15 is comprised of a valve operator portion, generally designated 17, supported on a body designated 19. The valve assemblies 15 are of a known construction as exemplified in U.S. patent application Ser. No. 565,278 now Pat. No. 3,972,505, for "Control Valve" filed Apr. 4, 1975 by Lawrence D. Padula and assigned to the assignee of this invention. Each of the valve assemblies 15 described in the aforementioned application and illustrated herein conventionally have three fluid ports 16, 18 and 20 within the body portion 19.

For certain applications, it is desirable to connect several valves in one or more common fluid paths, in which case the valve assemblies 15 are mounted on manifold blocks such as **10*a* and 10*b*, which are connected in banked or stacked end-to-end abutting engagement in accordance with the invention. In the illustrated embodiment all of the maniford blocks 10 are of identical modular form. Accordingly, when referring generally to a manifold block, it will be designated 10; whereas specific identification of a manifold block positioned within a stacked series will be further identified by an alphabetical subscript to the number 10**.

In the stacked block configuration, the several ports 16, 18 and 20 in each of the valve assemblies 15 are plugged and corresponding ports or ducts (not shown) are formed through the bottom of the body 19 for communicating with fluid passages 22, 24 and 26 respectively in each manifold block 10 through ports 65, 66 and 67 in the top of manifold block 10. Each valve assembly 15 is mounted on a manifold block 10 in fluid sealed relationship by seals, not shown, and mounting screws 27 which threadedly engage the manifold block 10 in tapped holes 90.

Each manifold block 10 is a metal casting of generally rectangular configuration and includes respective parallel top and bottom surfaces 30 and 31, respective parallel side surfaces 32 and 33 and respective parallel opposite end surfaces 34 and 35. Two longitudinally spaced fluid passages 22 extend laterally of the block 10 to a respective pair of longitudinally spaced, internally threaded ports 36 in each of sides 32 and 33 of the block for connection to respective external fluid conduits, not shown. While all ports 36 are shown as being open to permit connection with both sides of block 10, it will be appreciated that one or more of the ports 36 may be plugged. The fluid passages 24 and 26 are both singular and extend longitudinally of the manifold block 10 in laterally spaced relationship from end surface 34 to end surface 35. Fluid passages 24 and 26 each terminate at their opposite ends with internally threaded ports 37 and 38, each port 38 including a diametrically enlarged seal seat at its outer end in which an O-ring seal 39 is positioned. The port 38 for passage 26 is at the end surface 35 and the port 38 for the passage 24 is at the end surface 34.

The end surfaces 34, 35 of each manifold block 10 are flat for close opposing engagement with the respective opposite end surface 35 or 34 of the next adjacent manifold block. The seated seal 39 extends beyond the respective end surface 34 or 35 for fluid sealing engagement with the respective end surface 35 or 34 of the next adjacent block 10 and encircles the port 37 therein, thereby connecting the passages 24 and 26 in manifold blocks **10*a* in fluid tight relationship with those passages in the next adjacent block 10*b*. Vertical alignment of several stacked manifold blocks 10 is effected by a pin 40 and slot 41 at each end surface 35 positioned for mated vertical aligning engagement with a complementary slot 41 and pin 40 at the end surface 34 of each next adjacent manifold block. The pins 40 and slots 41 also serve to restrain relative twisting and vertical sliding movement between adjacent pairs of blocks 10 at their interface. The slots 41 are each laterally elongated relative to the pins 40 such that limited relative lateral motion between a slot 41 and a pin 40 inserted therein is possible when a pair of manifold blocks 10** are initially placed in abutment.

In accordance with the invention each pair of adjacent manifold blocks 10, e.g. 10*a*–10*b*, 10*b*–10*c*, etc., are connected to one another in fluid sealed end-to-end abutting engagement by an elongated fastener extending between and fixed at its opposite ends to the respective blocks of the pair to apply a compressive force therebetween. The fastener, which in the illustrated embodiment comprises a slotted-head screw 44, is housed within slots or cavities formed in the end-abutting pair of manifold blocks 10 to provide a compact configuration to the connected manifold blocks and to facilitate mounting the blocks on a smooth surface, as with screws (not shown) extending through vertical mounting holes 63 in the blocks.

Referring in greater detail to the arrangement for connecting the manifold blocks 10 in end-abutting relationship, the threaded shank end of a screw 44 is received in one or the other of a pair of openings or screw slots 49 and 50 which are formed in the bottom surface 31 of the manifold block 10 and which extend longitudinally of the block midway between the ports 36 and 37 from the respective end surfaces 34 and 35. The slots 49 and 50 intersect the respective end surfaces 34 and 35 of the block 10 somewhat above the bottom surface 31 to create openings 49*a* and 50*a* respectively thereat and are inclined upwardly toward the top surface 30 at an oblique angle of about 10° to the bottom surface 31. The screw slots 49 and 50 are of a width which snugly accommodates the diameter of the shank of screw 44 but are sufficiently narrow adjacent the respective end surfaces 34 and 35 to prevent longitudinal passage of the head 55 of the screw. A pair of openings or cavities 51 and 52 extend transversely of each manifold block 10 in the bottom surface 31 and intersect the respective screw slots 49 and 50 near the respective end surfaces 34 and 35 to widen the slots for housing the head 55 of screw 44 and to form respective planar abutment surfaces 53 and 54 against which the planar or flat based head 55 may bear. The abutment surfaces 53 and 54 are at an oblique angle of about 80° to the bottom surface 31 such that they are substantially perpendicular to the longitudinal extent of the adjacent slots 50 and 49 respectively in the next adjacent blocks 10.

The threaded end of each screw 44 is engaged by one of two nuts 46 each received and seated in a respective one of a pair of longitudinally spaced, transversely extending openings or nut slots 47 and 48 which extend downwardly into each manifold block 10 from the upper surface 30 thereof and intersect slots 49 and 50 respectively.

Each nut slot 47, 48 is contoured to provide a pair of opposed, vertically extending side surfaces 56 which are spaced to permit the introduction of a flat-sided nut 46 into the respective slot and to interfere with and substantially prevent its rotation therewithin. The nut slots 47, 48 extend downwardly into intersection with the respective bolt slots 49, 50, however the depth of the slots 47, 48 and the width of their sidewalls 56 is such that upwardly facing nut-seating surfaces 57 are formed at the bottom of each. The nut-seating surfaces 57 are positioned such that a nut 46 resting thereon is positioned to receive the threaded end of a bolt 44. Accordingly, the head 55 of screw 44 will engage an abutment surface 53 or 54 in one manifold block, i.e., surface 53 in block 10*c* as illustrated in FIG. 3, and the threaded end of the screw will extend into threaded engagement with a nut 46 which engages the abutment surface 59 or 58 respectively in slot 48 or 47 respectively, i.e. surface 59 in slot 48 in block 10*b* as illustrated in FIG. 3.

Interference surfaces 61, 62 cooperate with respective nut bearing surfaces 58, 59 to engage and retain a nut 46 which has been forced downwardly between one pair of the cooperating surfaces into contact with a seat 57 prior to its engagement with screw 44. The interference surfaces 61 and 62 face the nut abutment surfaces 58 and 59 respectively and are provided by the opposite faces of a web 60 which extends transversely of the manifold block 10 and separates the nut slots 47, 48. The interference surfaces 61, 62 extend substantially vertically in order to converge downwardly with the respective nut bearing surfaces 58, 59 such that near their respective lower ends they are spaced by a distance which is very slightly less than the thickness of the nut 46.

The nut slots 47 and 48, the screw slots 49 and 50, and the cavities 51 and 52 are all conveniently formed during the casting of the manifold block 10. Further, the depth and vertical incline of the screw slots 49 and 50, the depth of the nut slots 47 and 48, the diameter of the nut 46 and the length of the screw 44 are selected to contain the nut and screw entirely within, or between the top and bottom surfaces of the end adjacent pair of connected blocks 10. The size of cavities 51, 52 is sufficient to accommodate the head 55 of screw 44 therewithin preparatory to engagement with the nut 46, and to facilitate access of a screw driver during threading and final engagement of the screw with the nut.

Referring to FIG. 3, assembly of the several manifold blocks 10, 10*b* and 10*c* into end adjacent stacked relationship is accomplished by inserting an appropriately sized nut 46 into the nut slot 48 in block 10*b* and forcing it downward, as with a screw driver, into engagement with the seat 57; moving the end surface 34 of manifold block 10*c* into aligned, facing abutment with the end surface 35 of block 10*b*; placing screw 44 in the blocks 10*c* and 10*b*, with its head 55 in the cavity 51 of block 10*c* and the shank extending from cavity 51 through the opening 49*a* in the block 10*c* and through the opening 50*a* into the slot 50 in the block 10*b* in operative alignment with the nut; and finally threading the screw, as with a screw driver or the like, into tight threaded engagement with the nut. The compressive force developed between the blocks 10*b* and 10*c* maintains them in fluid sealed, end-to-end abutment. The identical operation is performed to connect the manifold block 10*a* to the other end of block 10*b*, with the head 55 of a second screw 44 now engaging abutment surface 53 of manifold block 10*b* and extending into threaded engagement with a nut, not shown, in manifold block 10*a*. Any lateral relative motion between adjacent blocks 10 permitted by the lateral extent of slots 41 relative to pins 40 is now prevented by the screws 44 being snugly housed within the slots 49 and 50.

Because of the symmetry of the porting in the manifold blocks 10, the alignment pins 40 and slots 41, and the various nut and screw head bearing surfaces, one manifold block may be reversed and connected to the other in the same aforedescribed manner. Also, the inclusion of a nut 46 in each of slots 47 and 48, combined with little or no extension of the end of screw 44 beyond the nut 46, permits two screws 44 to extend respectively from opposite ends of a manifold block 10 into threaded engagement with both nuts 46 in the block if so desired. Further, it will be appreciated that the slot-type openings 51 and 52 which intersect the respective screw slots 49 and 50 to define the respective screw head abutment surfaces 53 and 54 might alternatively be circular bores or the like, which are longitudinally aligned with the associated screw slot in the next adjacent manifold block and of sufficient diameter to accommodate a screw head 55.

As will be apparent to persons skilled in the art, various modifications, adaptations and variations of the foregoing specific disclosure can be made without departing from the teachings of the present invention.

We claim:

1. For use in operatively mounting a plurality of fluid control valves, a combination comprising a pair of valve mounting manifold blocks adapted to be stacked in aligned end-to-end abutment, the manifold blocks each having fluid passage means therein for conducting fluid controlled by valves mounted on an upper surface of the block, one block having an upper opening therein intermediate the ends of the block, a longitudinally extending slot and an end opening in one end of said one block communicating with the slot, the upper opening of said one block being accessible from its upper surface and intersecting the slot, the other block having a cavity and an opening in one end of said other block communicating with the cavity, the end openings in the blocks being registrable with one another when the blocks are in aligned end-to-end abutment, an elongated fastener having a head fixed on one end and an opposite threaded end, the fastener longitudinally extending from the slot in said one block into the cavity of the other block with the head of the fastener disposed within said cavity, and a nut received within the upper opening of said one block for threaded engagement with the threaded end of the fastener at the juncture of the upper opening and the slot for compressively engaging the ends of the blocks in fixed relation to one another.

2. The combination of claim 1 wherein each block includes a second opening formed in an end of the block opposite said one end, and wherein each block includes an elongated slot and a cavity communicating respectively with the openings at the opposite ends of the block.

3. The combination of claim 1 wherein the cavity in said other block is accessible from its bottom surface, wherein the body of said other block surrounding said cavity defines an internal abutment contained in a plane extending perpendicular to the fastener for engaging the bearing surface of its head, the threaded opposite end of the fastener being secured in fixed relation to said one block for compressively stacking the manifold blocks in end-to-end abutment, and wherein the fastener and nut are contained in their entirety within the confines of the manifold blocks.

4. The combination of claim 1 wherein the manifold blocks have complementary projection means and recess means formed on the ends of each block for mating engagement with the other block to effect alignment of the blocks.

5. The combination of claim 4 wherein the projection means and recess means cooperate to effect vertical alignment of the blocks and to restrain relative vertical sliding movement thereof at their interface, and the body of the block surrounding said slot cooperates with the fastener to restrain relative lateral sliding movement between the pair of manifold blocks.

6. The combination of claim 1 wherein the upper opening has confronting walls with opposed portions spaced apart a distance less than the thickness of the nut for securing the nut in interference with the walls upon seating the nut within the confines of said manifold block in its upper opening.

7. The combination of claim 1 wherein a second cavity and second intersecting upper opening and slot are formed in each manifold block in mirror image relation to said first cavity and first intersecting upper opening and slot such that each manifold block is adapted for reversible connection to the other block.

* * * * *